US006637514B1

(12) United States Patent
Donald et al.

(10) Patent No.: US 6,637,514 B1
(45) Date of Patent: Oct. 28, 2003

(54) RECOVERY OF PRODUCTION FLUIDS FROM AN OIL OR GAS WELL

(75) Inventors: Ian Donald, Moneymusk (GB); James Steele, Aberdeen (GB)

(73) Assignee: DES Enhanced Recovery Limited, Aberdeen (GB)

( * ) Notice: Subject to any disclaimer, the term of this patent is extended or adjusted under 35 U.S.C. 154(b) by 0 days.

(21) Appl. No.: 10/009,991

(22) PCT Filed: May 15, 2000

(86) PCT No.: PCT/GB00/01785

§ 371 (c)(1),
(2), (4) Date: Jul. 16, 2002

(87) PCT Pub. No.: WO00/70185

PCT Pub. Date: Nov. 23, 2000

(30) Foreign Application Priority Data

May 14, 1999 (GB) ..... 9911146

(51) Int. Cl.[7] ..... E21B 33/035

(52) U.S. Cl. ..... 166/368; 166/88.4; 166/95.1; 166/97.1

(58) Field of Search ..... 166/368, 95.1, 166/97.1, 75.12, 97.5, 88.4

(56) References Cited

U.S. PATENT DOCUMENTS

| | | | | |
|---|---|---|---|---|
| 3,101,118 A | | 8/1963 | Culver et al. | 166/75 |
| 4,260,022 A | | 4/1981 | Van Bilderbeek | 166/339 |
| 4,405,016 A | | 9/1983 | Best | 166/337 |
| 4,502,534 A | | 3/1985 | Roche et al. | 166/84 |
| 4,607,701 A | | 8/1986 | Gundersen | 166/368 |
| 4,848,473 A | * | 7/1989 | Lochte | 166/344 |
| 4,874,008 A | | 10/1989 | Lawson | 137/315 |
| 5,010,956 A | | 4/1991 | Bednar | 166/344 |
| 5,143,158 A | | 9/1992 | Watkins et al. | 166/344 |
| 5,535,826 A | | 7/1996 | Brown et al. | 166/363 |
| 5,544,707 A | * | 8/1996 | Hopper et al. | 166/382 |
| 5,868,204 A | | 2/1999 | Pritchett et al. | 166/368 |
| 5,971,077 A | * | 10/1999 | Lilley | 166/368 |
| 5,992,527 A | * | 11/1999 | Garnham et al. | 166/379 |
| 6,050,339 A | | 4/2000 | Milberger | 166/368 |
| 6,145,596 A | | 11/2000 | Dallas | 166/379 |
| 6,227,300 B1 | * | 5/2001 | Cunningham et al. | 166/339 |
| 6,460,621 B2 | * | 10/2002 | Fenton et al. | 166/347 |

FOREIGN PATENT DOCUMENTS

| | | | |
|---|---|---|---|
| EP | 0 841 464 A2 | 5/1998 | |
| GB | 2197675 A | 5/1988 | |
| GB | 2319795 A | 6/1998 | |
| GB | 2346630 | 8/2000 | E21B/33/035 |
| WO | WO 99/28593 | 6/1999 | E12B/33/037 |

* cited by examiner

*Primary Examiner*—Hoang Dang
(74) *Attorney, Agent, or Firm*—Drinker Biddle & Reath LLP

(57) ABSTRACT

A method and assembly for recovering production fluids from a well having a tree, using a conduit which is inserted into a production bore to divert the recovered fluids via chemical treatment, pumping or any other apparatus with minimal reduction in the rate of recovery of the production fluids.

14 Claims, 6 Drawing Sheets

RECOVERY OF PRODUCTION FLUIDS FROM AN OIL OR GAS WELL

The present invention relates to the recovery of production fluids from an oil or gas well having a christmas tree.

Christmas trees are well known in the art of oil and gas wells, and generally comprise an assembly of pipes, valves and fittings installed in a wellhead after completion of drilling and installation of the production tubing to control the flow of oil and gas from the well. Subsea Christmas trees typically have at least two bores one of which communicates with the production tubing (the production bore), and the other of which communicates with the annulus (the annulus bore). The annulus bore and production bore are typically side by side, but various different designs of Christmas tree have different configurations (ie concentric bores, side by side bores, and more than two bores etc).

Typical designs of christmas tree have a side outlet to the production bore closed by a production wing valve for removal of production fluids from the production bore. The top of the production bore and the top of the annulus bore are usually capped by a christmas tree cap which typically seals off the various bores in the christmas tree, and provides hydraulic channels for operation of the various valves in the christmas tree by means of intervention equipment, or remotely from an offshore installation.

In low pressure wells, it is generally desirable to boost the pressure of the production fluids flowing through the production bore, and this is typically done by installing a pump or similar apparatus after the production wing valve in a pipeline or similar leading from the side outlet of the christmas tree. However, installing such a pump in an active well is a difficult operation, for which production must cease for some time until the pipeline is cut, the pump installed, and the pipeline resealed and tested for integrity.

A further alternative is to pressure boost the production fluids by installing a pump from a rig, but this requires a well intervention from the rig, which can be even more expensive than breaking the subsea or seabed pipework.

According to the present invention there is provided a method of recovering production fluids from a well having a tree, the tree having a first flowpath and a second flowpath, the method comprising diverting fluids from a first portion of the first flowpath to the second flowpath, and diverting the fluids from the second flowpath back to a second portion of the first flowpath, and thereafter recovering fluids from the outlet of the first flowpath.

Preferably the first flowpath is a production bore, and the first portion of it is typically a lower part near to the wellhead. The second portion of the is first flowpath is typically an upper portion of the bore adjacent a branch outlet, although the second portion can be in the branch or outlet of the first flowpath.

The diversion of fluids from the first flowpath allows the treatment of the fluids (eg with chemicals) or pressure boosting for more efficient recovery before re-entry into the first flowpath.

Optionally the second flowpath is an annulus bore, or a conduit inserted into the first flowpath. Other types of bore may optionally be used for the second flowpath instead of an annulus bore.

Typically the flow diversion from the first flowpath to the second flowpath is achieved by a cap on the tree. Optionally, the cap contains a pump or treatment apparatus, but this can preferably be provided separately, or in another part of the apparatus, and in most embodiments, flow will be diverted via the cap to the pump etc and returned to the cap by way of tubing. A connection typically in the form of a conduit is typically provided to transfer fluids between the first and second flowpaths.

The invention also provides a flow diverter assembly for a tree, the flow diverter assembly comprising flow diverter means to divert fluids from a first portion of the first flowpath to a second flowpath, and means to divert fluids from the second flowpath back to a second portion of the first flowpath for recovery therefrom via the outlet of the first flowpath.

Typically, the diverter assembly can be formed from high grade steels or other metals, using eg resilient or inflatable sealing means as required.

The assembly may include outlets for the first and second flowpaths, for diversion of the fluids to a pump or treatment assembly.

The assembly preferably comprises a conduit capable of insertion into the first flowpath the assembly having sealing means capable of sealing the conduit against the wall of the production bore. The conduit may provide a flow diverter through its central bore which typically leads to a christmas tree cap and the pump mentioned previously. The seal effected between the conduit and the first flowpath prevents fluid from the first flowpath entering the annulus between the conduit and the production bore except as described hereinafter. After passing through a typical booster pump, squeeze or scale chemical treatment apparatus, the fluid is diverted into the second flowpath and from there to a crossover back to the first flowpath and first flowpath outlet.

The assembly and method are typically suited for subsea production wells in normal mode or during well testing, but can also be used in subsea water injection wells, land based oil production injection wells, and geothermal wells.

The pump can be powered by high pressure water or by electricity which can be supplied direct from a fixed or floating offshore installation, or from a tethered buoy arrangement, or by high pressure gas from a local source.

The cap preferably seals within christmas tree bores above the upper master valve. Seals between the cap and bores of the tree are optionally O-ring, inflatable, or preferably metal-to-metal seals. The cap can be retro-fitted very cost effectively with no disruption to existing pipework and minimal impact on control systems already in place.

The typical design of the flow diverters within the cap can vary with the design of tree, the number, size, and configuration of the diverter channels being matched with the production and annulus bores, and others as the case may be. This provides a way to isolate the pump from the production bore if needed, and also provides a bypass loop.

The cap is typically capable of retro-fitting to existing tree caps, and many include equivalent hydraulic fluid conduits for control of tree valves, and which match and co-operate with the conduits or other control elements of the tree to which the cap is being fitted.

In most preferred embodiments, the cap has outlets for production and annulus flow paths for diversion of fluids away from the cap.

Embodiments of the invention will now be described by way of example and with reference to the accompanying drawings in which.

Figure 1:
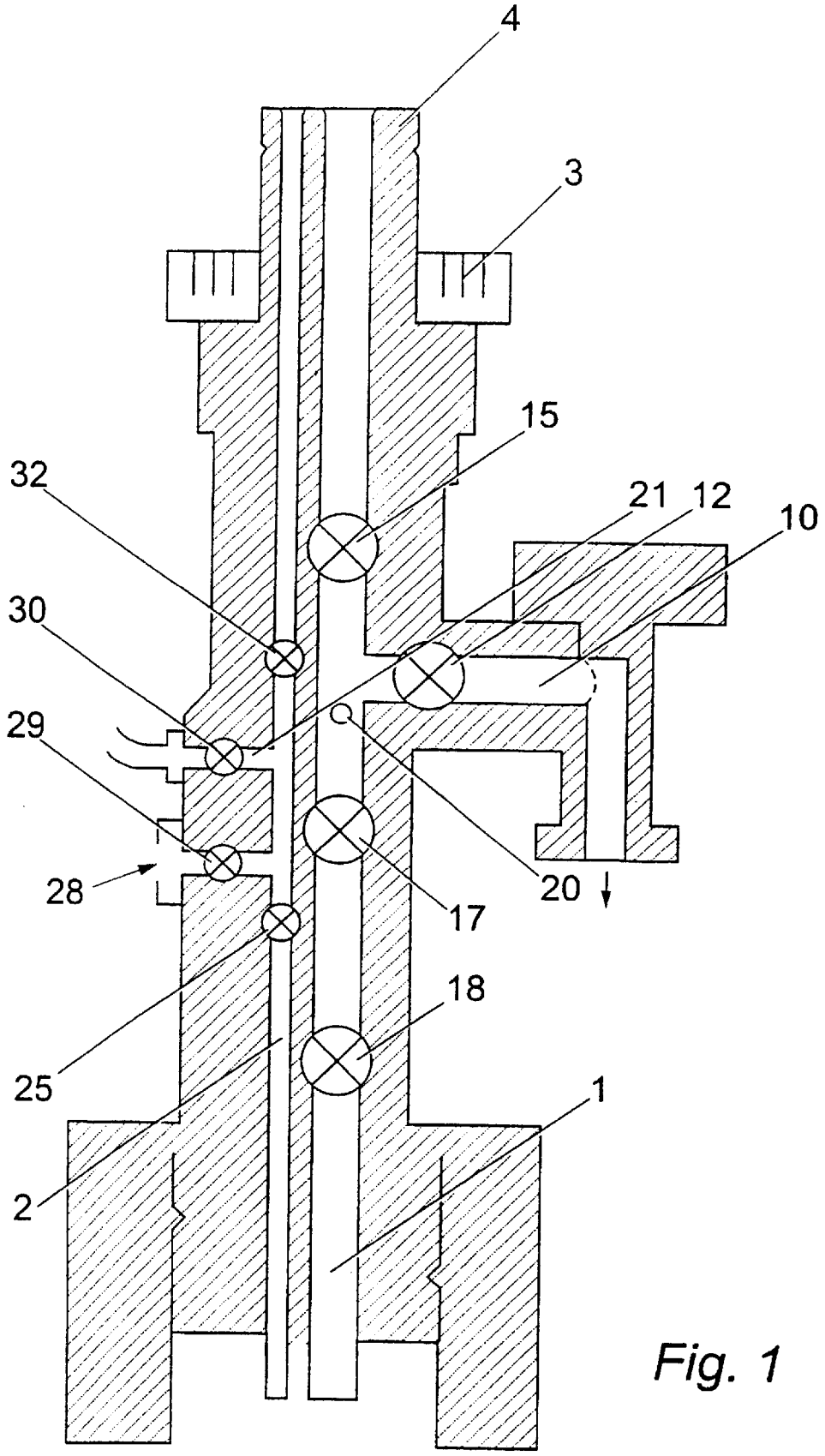
FIG. 1 is a side sectional view of a typical production tree.
Figure 3A:
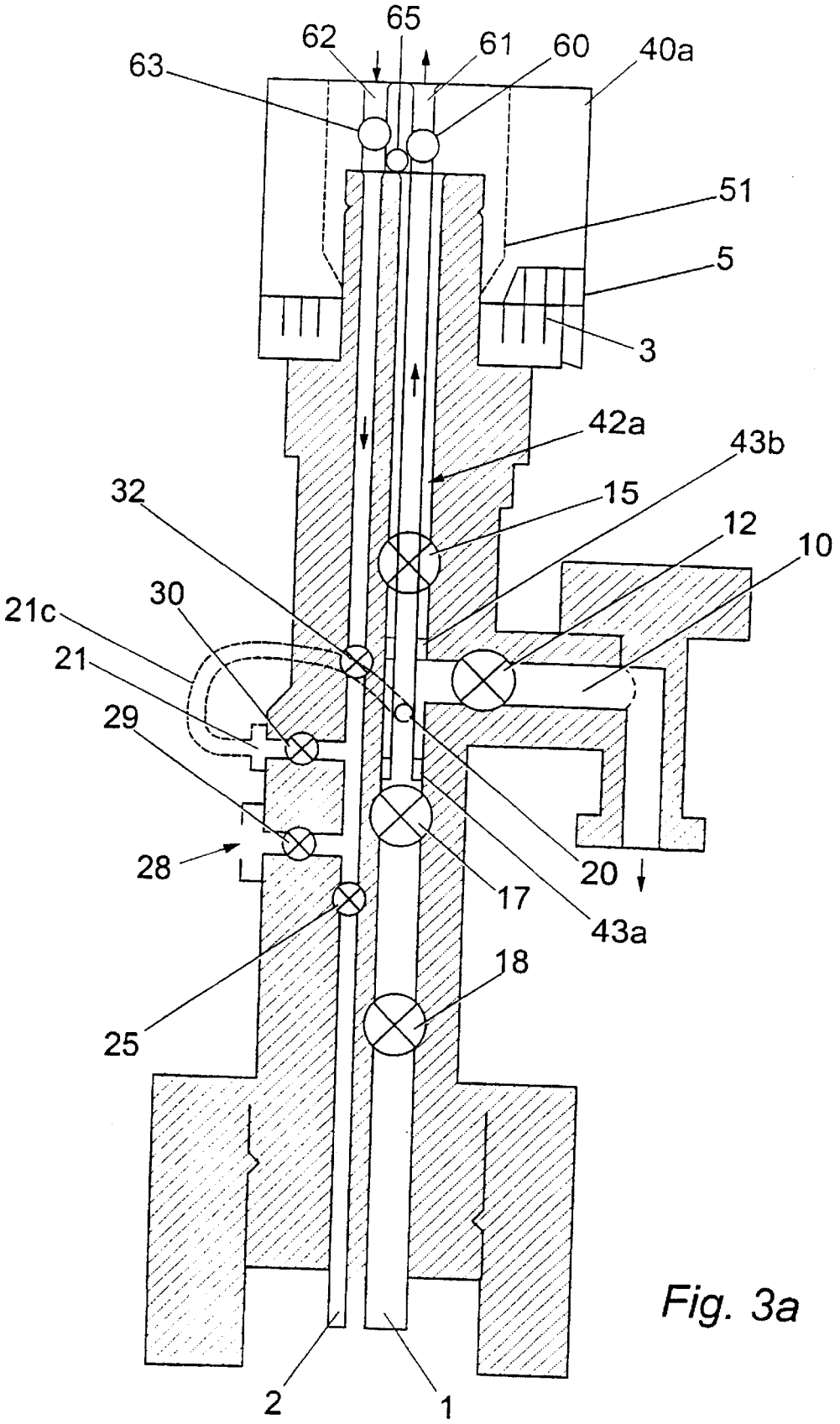
Figure 3B:
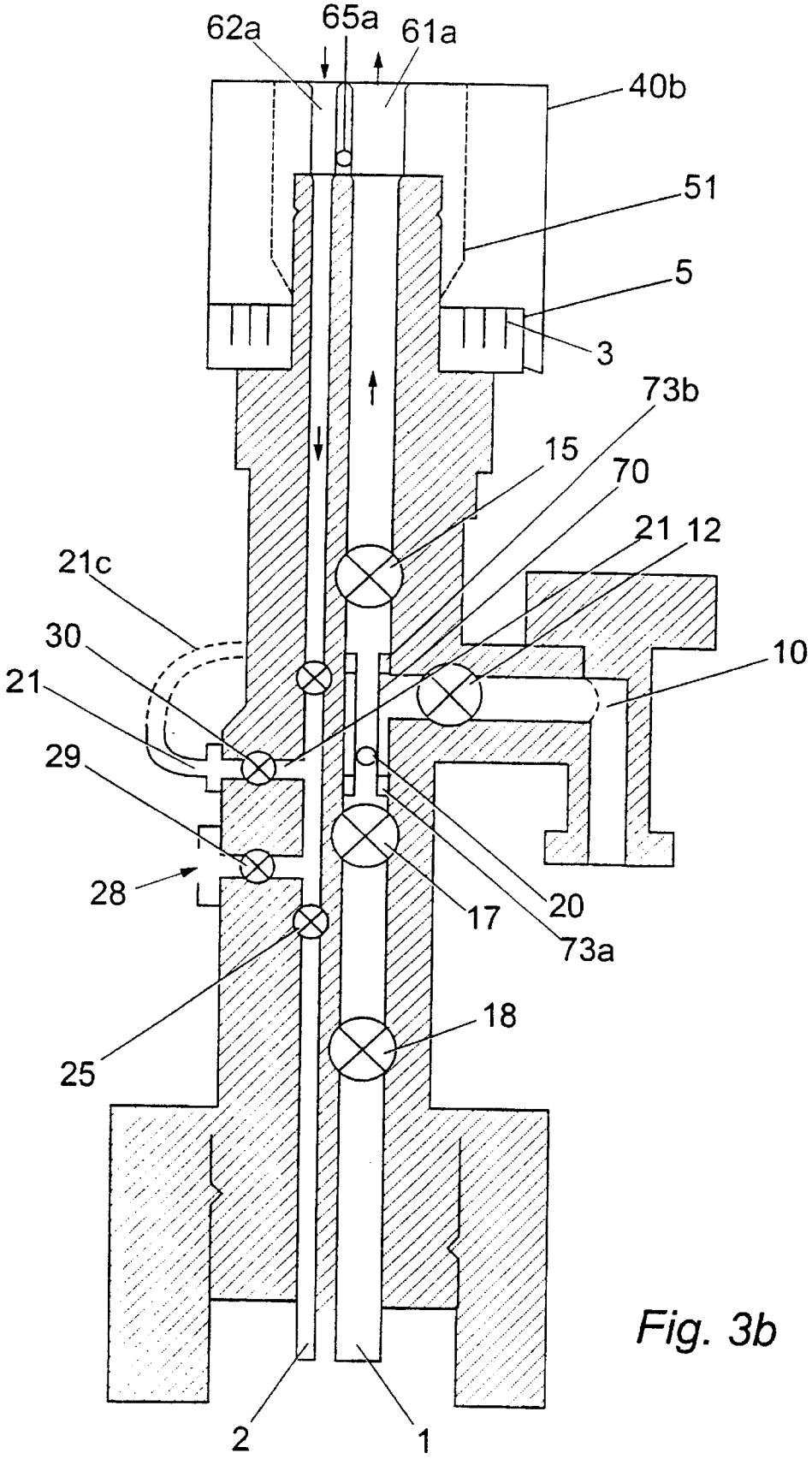
Figure 4A:
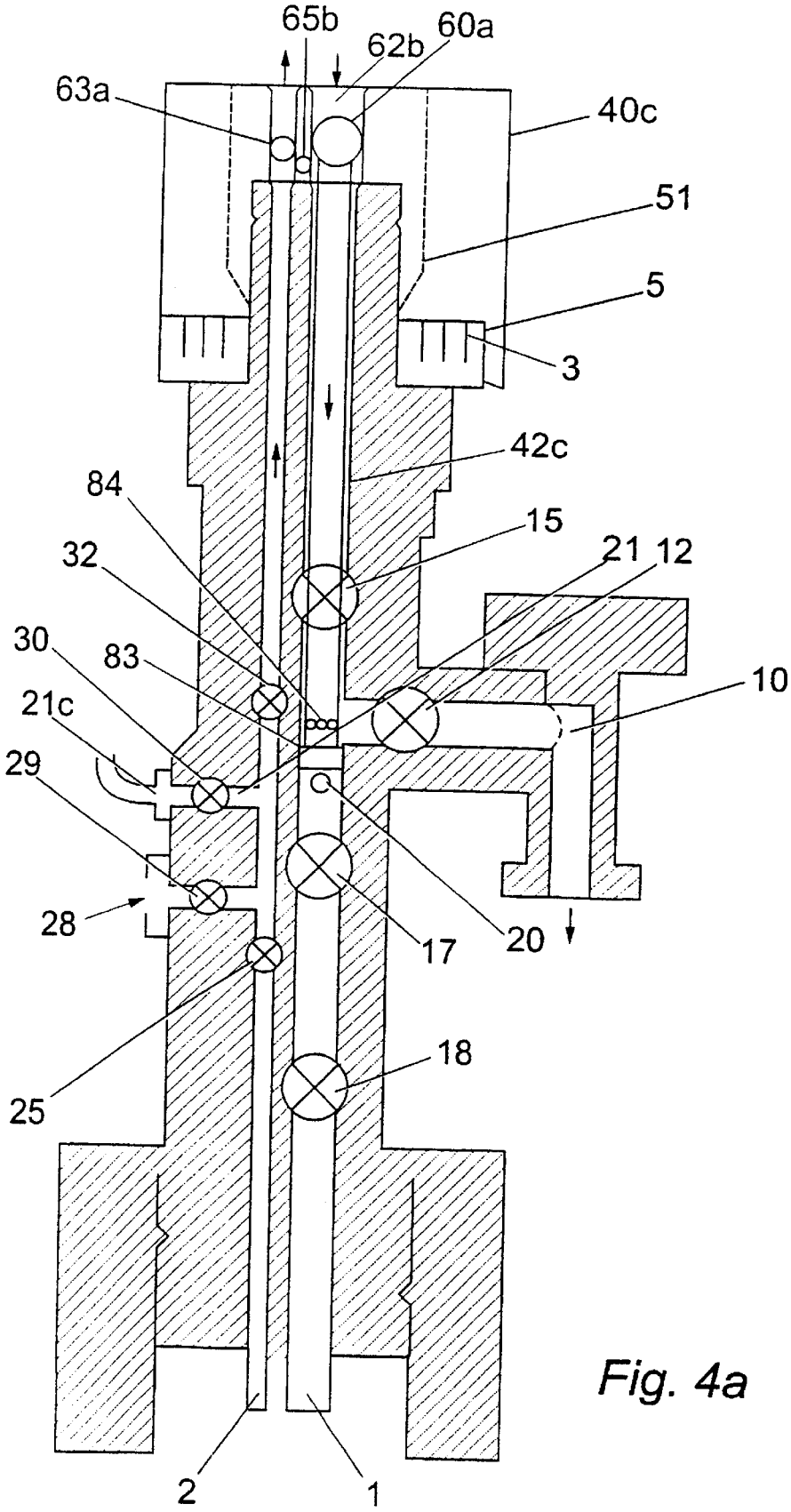
Figure 4B:
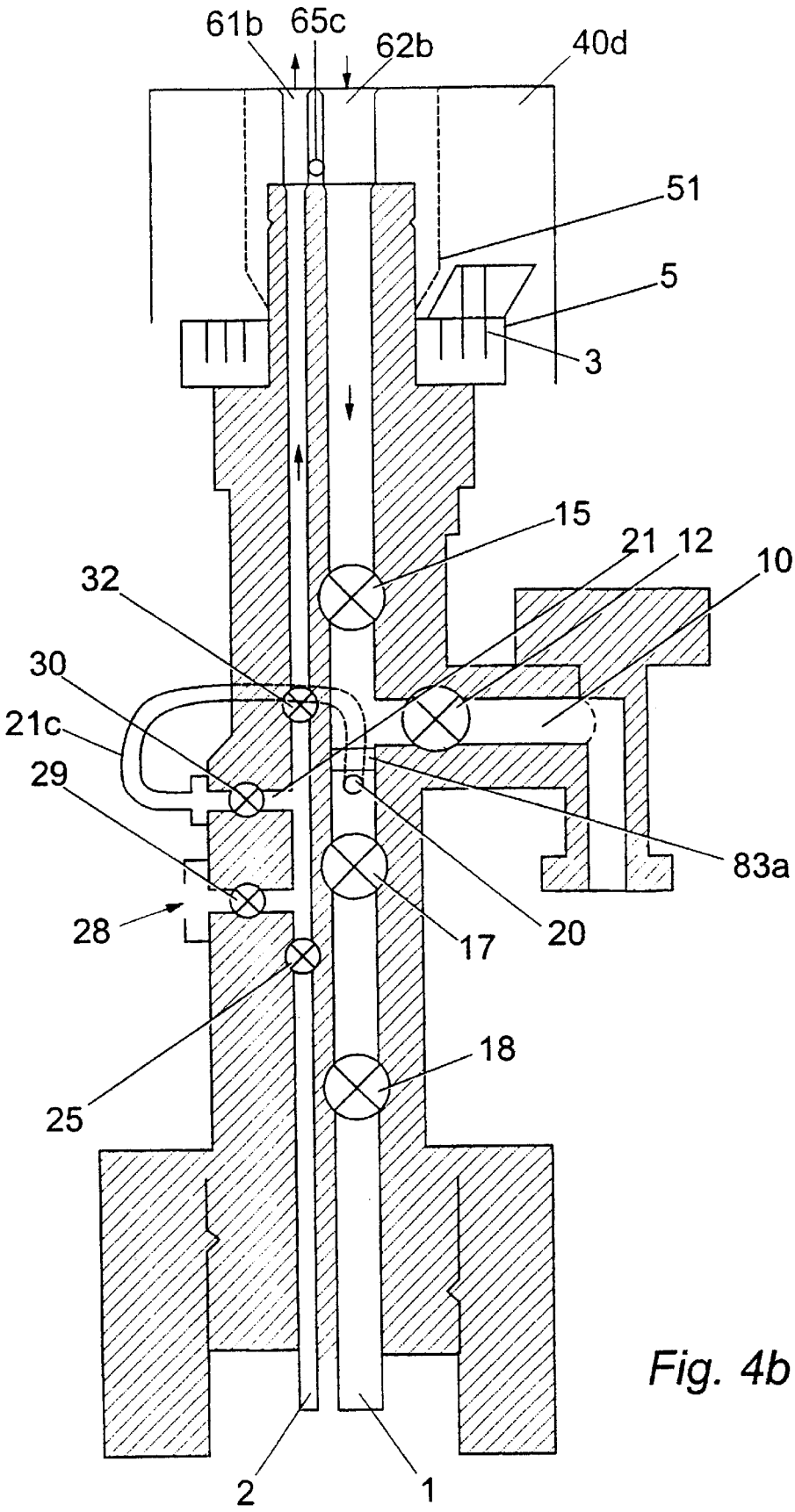

FIG. 3*a* is a view of the FIG. 1 tree with a second embodiment of a cap in place;

FIG. 3*b* is a view of the FIG. 1 tree with a third embodiment of a cap in place;

FIG. 4*a* is a view of the FIG. 1 tree with a fourth embodiment of a cap in place; and FIG. 4*b* is a side view of the FIG. 1 tree with a fifth embodiment of a cap in place.

Referring now to the drawings, a typical production tree on an offshore oil or gas wellhead comprises a production bore 1 leading from production tubing (not shown) and carrying production fluids from a perforated region of the production casing in a reservoir (not shown). An annulus bore 2 leads to the annulus between the casing and the production tubing and a christmas tree cap 4 which seals off the production and annulus bores 1, 2, and provides a number of hydraulic control channels 3 by which a remote platform or intervention vessel can communicate with and operate the valves in the christmas tree. The cap 4 is removable from the christmas tree in order to expose the production and annulus bores in the event that intervention is required and tools need to be inserted into the production or annulus bores 1, 2.

The flow of fluids through the production and annulus bores is governed by various valves shown in the typical tree of FIG. 1. The production bore 1 has a branch 10 which is closed by a production wing valve (PWV) 12. A production swab valve (PSV) 15 closes the production bore 1 above the branch 10 and PWV 12.

Two lower valves UPMV 17 and LPMV 18 (which is optional) close the production bore 1 below the branch 10 and PWV 12. Between UPMV 17 and PSV 15, a crossover port (XOV) 20 is provided in the production bore 1 which connects to the crossover port (XOV) 21 in annulus bore 2.

The annulus bore is closed by an annulus master valve (AMV) 25 below an annulus outlet 28 controlled by an annulus wing valve (AWV) 29, itself below crossover port 21. The crossover port 21 is closed by crossover valve 30. An annulus swab valve 32 located above the crossover port 21 closes the upper end of the annulus bore 2.

All valves in the tree are typically hydraulically controlled (with the exception of LPMV 18 which may be mechanically controlled) by means of hydraulic control channels 3 passing through the cap 4 and the body of the tool or via hoses as required, in response to signals generated from the surface or from an intervention vessel.

When production fluids are to be recovered from the production bore 1, LPMV 18 and UPMV 17 are opened, PSV 15 is closed, and PWV 12 is opened to open the branch 10 which leads to the pipeline (not shown). PSV 15 and ASV 32 are only opened if intervention is required.

Figure 2:
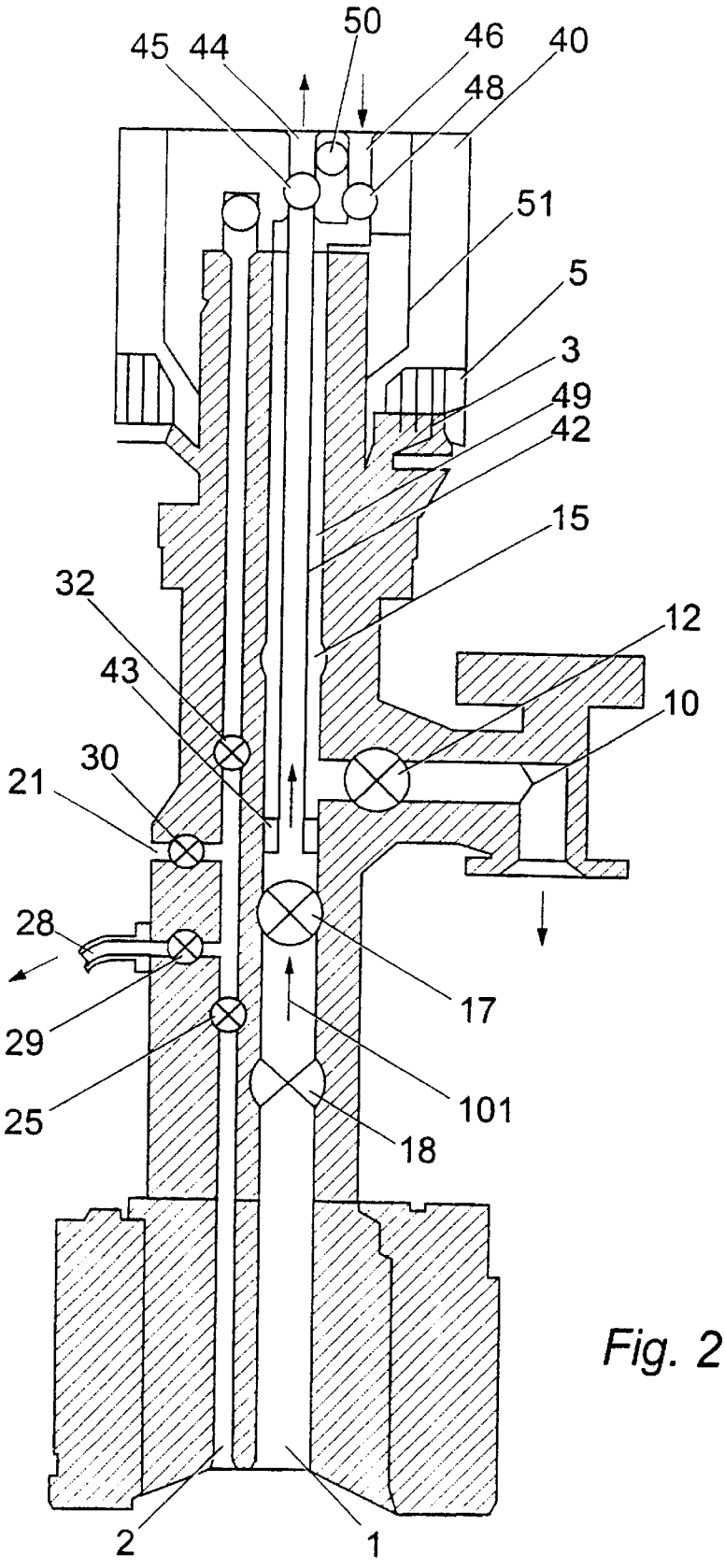
FIG. 2 is a side view of the FIG. 1 tree with a diverter cap in place.

Referring now to FIG. 2, a wellhead cap 40 has a hollow conduit 42 with metal, inflatable or resilient seals 43 at its lower end which can seal the outside of the conduit 42 against the inside walls of the production bore 1, diverting production fluids flowing up the production bore 1 in the direction of arrow 101 into the hollow bore of the conduit 42 and from there to the cap 40. The bore of conduit 42 can be closed by a cap service valve (CSV) 45 which is normally open but can close off an outlet 44 of the hollow bore of the conduit 42. Outlet 44 leads via tubing (not shown) to a wellhead booster pump or chemical treatment etc to be applied to the production fluids flowing from the bore of the conduit 42. The booster pump and chemical treatment apparatus is not shown in this embodiment. After application of pressure from the booster pump or chemical treatment as appropriate, the production fluids are returned via tubing to the production inlet 46 of the cap 40 which leads via cap flowline valve (CFV) 48 to the annulus between the conduit 42 and the production bore 1. Production fluids flowing into the inlet 46 and through valve 48 flow down the annulus 49 through open PSV 15 and diverted by seals 43 out through branch 10 since PWV 12 is open. Production fluids can thereby be recovered via this diversion. The conduit bore and the inlet 46 can also have an optional crossover valve (COV) designated 50, and a tree cap adapter 51 in order to adapt the flow diverter channels in the tree cap 40 to a particular design of tree head. Control channels 3 are mated with a cap controlling adapter 5 in order to allow continuity of electrical or hydraulic control functions from surface or an intervention vessel.

This embodiment therefore provides a fluid diverter for use with a wellhead tree comprising a thin walled diverter conduit and a seal stack element connected to a modified christmas tree cap, sealing inside the production bore of the christmas tree typically above the hydraulic master valve, diverting flow through the diverter conduit and the top of the christmas tree cap and tree cap valves to typically a pressure boosting device or chemical treatment apparatus, with the return flow routed via the tree cap to the annular space between the diverter conduit and the existing tree bore through the wing valve to the flowline.

Referring to FIG. 3*a*, a further embodiment of a cap 40*a* has a large diameter conduit 42*a* extending through the open PSV 15 and terminating in the production bore 1 having seal stack 43*a* below the branch 10, and a further seal stack 43*b* sealing the bore of the conduit 42*a* to the inside of the production bore 1 above the branch 10, leaving an annulus between the conduit 42*a* and bore 1. Seals 43*a* and 43*b* are disposed on an area of the conduit 42*a* with reduced diameter in the region of the branch 10. Seals 43*a* and 43*b* are also disposed on either side of the crossover port 20 communicating via channel 21*c* to the crossover port 21 of the annulus bore 2. In the cap 40*a*, the conduit 42*a* is closed by cap service valve (CSV) 60 which is normally open to allow flow of production fluids from the production bore 1 via the central bore of the conduit 42 through the outlet 61 to the pump or chemical treatment apparatus. The treated or pressurised production fluid is returned from the pump or treatment apparatus to inlet 62 in the annulus bore 2 which is controlled by cap flowline valve (CFV) 63. Annulus swab valve 32 is normally held open, annulus master valve 25 and annulus wing valve 29 are normally closed, and crossover valve 30 is normally open to allow production fluids to pass through crossover channel 21*c* into crossover port 20 between the seals 43*a* and 43*b* in the production bore 1, and thereafter through the open PWV 12 into the bore 10 for recovery to the pipeline. A crossover valve 65 is provided between the conduit bore 42*a* and the annular bore 2 in order to bypass the pump or treatment apparatus if desired. Normally the crossover valve 65 is maintained closed.

This embodiment maintains a fairly wide bore for more efficient recovery of fluids at relatively high pressure, thereby reducing pressure drops across the apparatus.

This embodiment therefore provides a fluid diverter for use with a wellhead tree comprising a thin walled diverter with two seal stack elements, connected to a tree cap, which straddles the crossover valve outlet and flowline outlet (which are approximately in the same horizontal plane), diverting flow through the centre of the diverter conduit and the top of the tree cap to pressure boosting or chemical treatment apparatus etc, with the return flow routed via the tree cap and annulus bore (or annulus flow path in concentric trees) and the crossover loop and crossover outlet, to the annular space between the straddle and the existing xmas tree bore through the wing valve to the flowline.

FIG. 3*b* shows a simplified version of a similar embodiment, in which the conduit 42*a* is replaced by a production bore straddle 70 having seals 73*a* and 73*b* having the same position and function as seals 43*a* and 43*b* described with reference to the FIG. 3*a* embodiment. In the FIG. 3*b* embodiment, production fluids passing through open LPMV 18 and UPMV 17 are diverted through the straddle 70, and through open PSV 11 and outlet 61*a*. From there, the production fluids are treated or pressurised as the case may be and returned to inlet 62*a* where they are diverted as previously described through channel 21*c* and crossover port 20 into the annulus between the straddle 70 and the production bore 1, from where they can pass through the open valve PWV 12 into the branch 10 for recovery to a pipeline.

This embodiment therefore provides a fluid diverter for use with a wellhead tree which is not connected to the tree cap by a thin walled conduit, but is anchored in the tree bore, and which allows full bore flow above the "straddle" portion, but routes flow through the crossover and will allow a swab valve (PSV) to function normally.

The FIG. 4*a* embodiment has a different design of cap 40*c* with a wide bore conduit 42*c* extending down the production bore 1 as previously described. The conduit 42*c* substantially fills the production bore 1, and at its distal end seals the production bore at 83 just above the crossover port 20, and below the branch 10. The PSV 15 is, as before, maintained open by the conduit 42*c*, and perforations 84 at the lower end of the conduit are provided in the vicinity of the branch 10. In the FIG. 4*a* embodiment, LPMV 18 and UPMV 17 are held open and production fluids in the production bore 1 are diverted by the seal 83 through the XOV port 20 and channel 21*c* into the XOV port 21 of the annulus bore 2. XOV valve 30 into the annulus bore is open, AMV 25 is closed as is AWV 29. ASV 32 is opened and production fluids passing through the crossover into the annulus bore 2 are diverted up through the annulus bore 2, through the open service valve (CSV) 63*a* through the chemical treatment or pump as required and back into the inlet 62*b* of the production bore 1. Cap flowline valve (CFV) 60*a* is open allowing the production fluids to flow into the bore of the conduit 42*c* and out of the apertures 84, through open PWV 12 and into the branch 10 for recovery to the pipeline. Crossover valve 65b is provided between the production bore 1 and annulus bore 2 in order to bypass the chemical treatment or pump as required.

This embodiment therefore provides a fluid diverter for use with a wellhead tree comprising a thin walled conduit connected to a tree cap, with one seal stack element, which is plugged at the bottom, sealing in the production bore above the hydraulic master valve and crossover outlet (where the crossover outlet is below the horizontal plane of the flowline outlet), diverting flow through the crossover outlet and annulus bore (or annulus flow path in concentric trees) through the top of the tree cap to a treatment or booster with the return flow routed via the tree cap through the bore of the conduit 42, exiting therefrom through perforations 84 near the plugged end, and passing through the annular space between the perforated end of the conduit and the existing tree bore to the production flowline.

Referring now to FIG. 4*b*, a modified embodiment dispenses with the conduit 42*c* of the FIG. 4*a* embodiment, and simply provides a seal 83*a* above the XOV port 20 and below the branch 10. LPMV 18 and UPMV 17 are opened, and the seal 83*a* diverts production fluids in the production bore 1 through the crossover port 20, crossover channel 21*c*, crossover valve 30 and crossover port 21 into the annulus bore 2. AMV 25 and AWV 29 are closed, ASV 32 is opened allowing production fluids to flow up the annulus bore 2 through outlet 61*b* to the chemical treatment apparatus or to the pump (or both) as required, and is returned to the inlet 62*b* of the production tubing 1 where it flows down through open PSV 15, and is diverted by seal 83*a* into branch 10 and through open PWV 12 into the pipeline for recovery.

This embodiment provides a fluid diverter for use with a wellhead tree which is not connected to the tree cap by a thin walled conduit, but is anchored in the tree bore and which routes the flow through the crossover and allows full bore flow for the return flow, and will allow the swab valve to function normally.

Embodiments of the invention can be retrofitted to many different existing designs of wellhead tree, by simply matching the positions and shapes of the hydraulic control channels 3 in the cap, and providing flow diverting channels or connected to the cap which are matched in position (and preferably size) to the production, annulus and other bores in the tree. Therefore, the invention is not limited to the embodiments specifically described herein, but modifications and improvements can be made without departing from its scope.

What is claimed is:

1. A method of recovering production fluids from a well having a christmas tree, the christmas tree having a first flowpath which has an outlet, and a second flowpath, the method comprising diverting fluids from a first portion of the first flowpath to the second flowpath, and diverting the fluids from the second flowpath back to a second portion of the first flowpath, and thereafter recovering fluids from the outlet of the first flowpath.

2. A method as claimed in claim 1, wherein the first flowpath is a production bore.

3. A method as claimed in claim 1, wherein the second flowpath is an annulus bore.

4. A method as claimed in claim 1, wherein the fluids are diverted from the first flowpath through a conduit disposed in the first flowpath, and wherein the fluids are returned via the annulus between the conduit and the first flowpath.

5. A method as claimed in claim 4, wherein the bore of the conduit provides the second flowpath.

6. A method as claimed in claim 4, wherein the conduit is sealed to the first flowpath across an outlet of the flowpath.

7. A method as claimed in claim 1, wherein the christmas tree is attached to a wellhead, and wherein the first portion of the first flowpath is a lower part of the first flowpath proximate to the wellhead.

8. A method as claimed in claim 1, wherein the fluids are returned to the first flowpath at an upper portion of the first flowpath.

9. A method as claimed in claim 1, wherein the fluids are diverted via a cap connected to the tree.

10. A method as claimed in claim 9, wherein the fluids are diverted via the cap from the second flowpath to the second portion of the first flowpath.

11. A method as claimed in claim 9, wherein the fluids are diverted via the cap from the second portion of the first flowpath to the second flowpath.

12. A method as claimed in claim 9, wherein a pump or treatment apparatus is provided in the cap.

13. A method as claimed in claim 1, wherein a pump or chemical treatment apparatus is connected between the first and second flowpaths.

14. A method as claimed in claim 1, wherein the fluids are diverted through a crossover conduit between the first flowpath and the second flowpath.

* * * * *